US005813963A

United States Patent [19]

Erickson

[11] Patent Number: 5,813,963

[45] Date of Patent: Sep. 29, 1998

[54] METHOD AND APPARATUS FOR ASSEMBLING ROE CONTAINERS

[75] Inventor: Arlen Jerome Erickson, Bainbridge Island, Wash.

[73] Assignee: Fraser Box & Trading Co. Ltd., Surrey, Canada

[21] Appl. No.: 581,465

[22] Filed: Dec. 29, 1995

[51] Int. Cl.[6] ..... B67B 1/04; B31B 1/90

[52] U.S. Cl. ..... 493/102; 493/103; 53/485; 53/489; 53/312; 53/300; 53/420; 53/128.1

[58] Field of Search ..... 493/102, 103, 493/104, 108, 109, 111, 113, 114, 115, 121, 126, 136, 137, 138, 139, 379, 383, 389, 390, 391; 53/485, 489, 310, 311, 312, 30, 420, 128.1

[56] References Cited

U.S. PATENT DOCUMENTS

| | | | |
|---|---|---|---|
| 2,894,361 | 7/1959 | Ullman | 53/289 |
| 3,295,293 | 1/1967 | Lodding | 53/289 |
| 3,383,834 | 5/1968 | Switliski | 53/289 |
| 3,408,787 | 11/1968 | Mueller | 53/289 |
| 3,412,526 | 11/1968 | Bennert | 53/289 |
| 3,511,025 | 5/1970 | Newport | 53/367 |
| 5,588,283 | 12/1996 | Martin | 53/486 |

OTHER PUBLICATIONS

Please see attached "Memorandum A". No Date.

*Primary Examiner*—Joseph J. Hail, III
*Assistant Examiner*—Christopher W. Day
*Attorney, Agent, or Firm*—John Russell Uren

[57] ABSTRACT

A container assembly apparatus and method for assembling a roe shipping container. The lid of the container is manually positioned in contact with one edge of the container. A first button is pressed which allows swing arm to open and allow access by the container and lid to the assembly apparatus. As the container and lid move into the assembly apparatus, rails move the lid downwardly and into a closer relationship with the top edges of the container. A second swing arm terminates movement of the container and lid and maintains them in the assembly location under the apparatus. A second button is pressed and a platen moves downwardly to install the lid on the body of the container while simultaneously inserting a plug into an opening in the bottom of the container. The second button is released which allows the second swing arm to open the container to be moved from its assembly location.

26 Claims, 7 Drawing Sheets

METHOD AND APPARATUS FOR ASSEMBLING ROE CONTAINERS

INTRODUCTION

This invention relates to a method and apparatus for the assembly and closure of plastic containers and, more particularly, to a method and apparatus for the assembly and closure of plastic containers which hold fish roe.

BACKGROUND OF THE INVENTION

Fish roe and, more particularly, salmon roe, is considered a delicacy in many countries and the industry to supply such roe to consuming countries is a large one. Typically, the roe is shipped to its destination in containers, either wood or plastic, although the number of wooden containers has fallen dramatically due to the difficulty of obtaining wood for the containers at a reasonable price. The use of plastic containers for shipping the row to consumers is more widespread.

Containers for holding the roe are known. Such a container is described in our copending U.S. patent application Ser. No. 08/131,682 filed Oct. 5, 1993 in the name of the same applicant. The container has a plastic body portion, a plastic lid which snaps closed on the body portion and a hole in the floor or bottom of the container to allow for the drainage of the fluid originating in the roe when it is placed in the container.

In loading the container with roe and thereafter closing the container by snap attaching the lid to the body of the container, the operation is typically done manually. Salmon or fish roe is placed into the body of the container with the hole in the floor open so that fluid from the roe can drain from the container during the loading operation. Thereafter, a plastic lid is placed on the body of the container and snap fitted to complementary rails on the lid of the container. The operator will then rotate or turn over the container and insert a plug into the hole in the bottom of the container. The container is again rotated until it is upright and is then moved to a shipping area with other containers downstream from the closing area. The present manual process is disadvantageous because it is labor intensive, inefficient and time consuming.

There have been attempts to speed up the process using a partially automatic assembly and closing machine. The known machine consists of a handle which is manually operated. The handle is connected to both a platen which is intended to press the lid into its closing snap fit onto the container and to a movable arm which applies pressure on a plug while inserting the plug into the plug hole on the bottom of the container. It's operation is generally as follows; first, the lid is positioned on the container manually without fitting it thereon and a plug for the container hole in positioned on a stationary bottom plate which is located beneath the container in its assembly location. The container is then manually moved into the assembly area against a step intended to maintain the container in its assembly location. The container is then manually held in the position against the stop while the arm of the machine is manually moved downwardly with the platen attached. The arm is likewise connected to an extension beneath the container and inserts the plug into the hole in the bottom of the container simultaneously with the installation of the container lid on the container. Thereafter, the container is manually lifted over the step and pushed toward the shipping area.

While this apparatus likely offers some improvement over the wholly manual assembly operation, there continue to be disadvantages. One disadvantage is that the lid is positioned on the container in a position where it could be completely installed by the application of somewhat more pressure thereby rendering the application of the pressure on the lid by the mechanical arm and platen unnecessary. Secondly, the arm must be manually operated which is time consuming and the container must be manually held in position during the assembly operation. Third, the plug must still be individually and manually positioned in a location where it can then be inserted using the lever action undertaken by the operator. Thus, any significant saving of manual labor is questionable.

SUMMARY OF THE INVENTION

According to one aspect of the invention, there is provided a method of assembling a lid to a body of a container and inserting a plug into an opening on the floor of the container, said method comprising the steps of manually bringing the lid of the container into contact with the body of said container at at least one side of said lid and said container, positioning said container in an operating location and maintaining said container in said operating location, applying pressure to said lid of said container thereby to operably assemble said lid to said body of said container while simultaneously moving said plug from a plurality of plugs and inserting said plug into said hole.

According to a further aspect of the invention, there is provided apparatus for the assembly of a lid to a body of a container and of a plug in an opening in the bottom of said container, said apparatus comprising a storing mechanism for the storage of a plurality of plugs, a platen movable on a press and being operable to contact and press said lid into a closing relationship with said body of said container, a plug removal and plug insertion mechanism for removing one plug from said plurality of plugs, transferring said one plug to said hole of said bottom of said container and inserting said one plug into said hole of said container while simultaneously applying pressure to said lid by said platen.

BRIEF DESCRIPTION OF THE SEVERAL VIEWS OF THE DRAWINGS

An embodiment of the invention will now be described, by way of example only, with the use of drawings in which.

DESCRIPTION OF SPECIFIC EMBODIMENT

Figure 1:
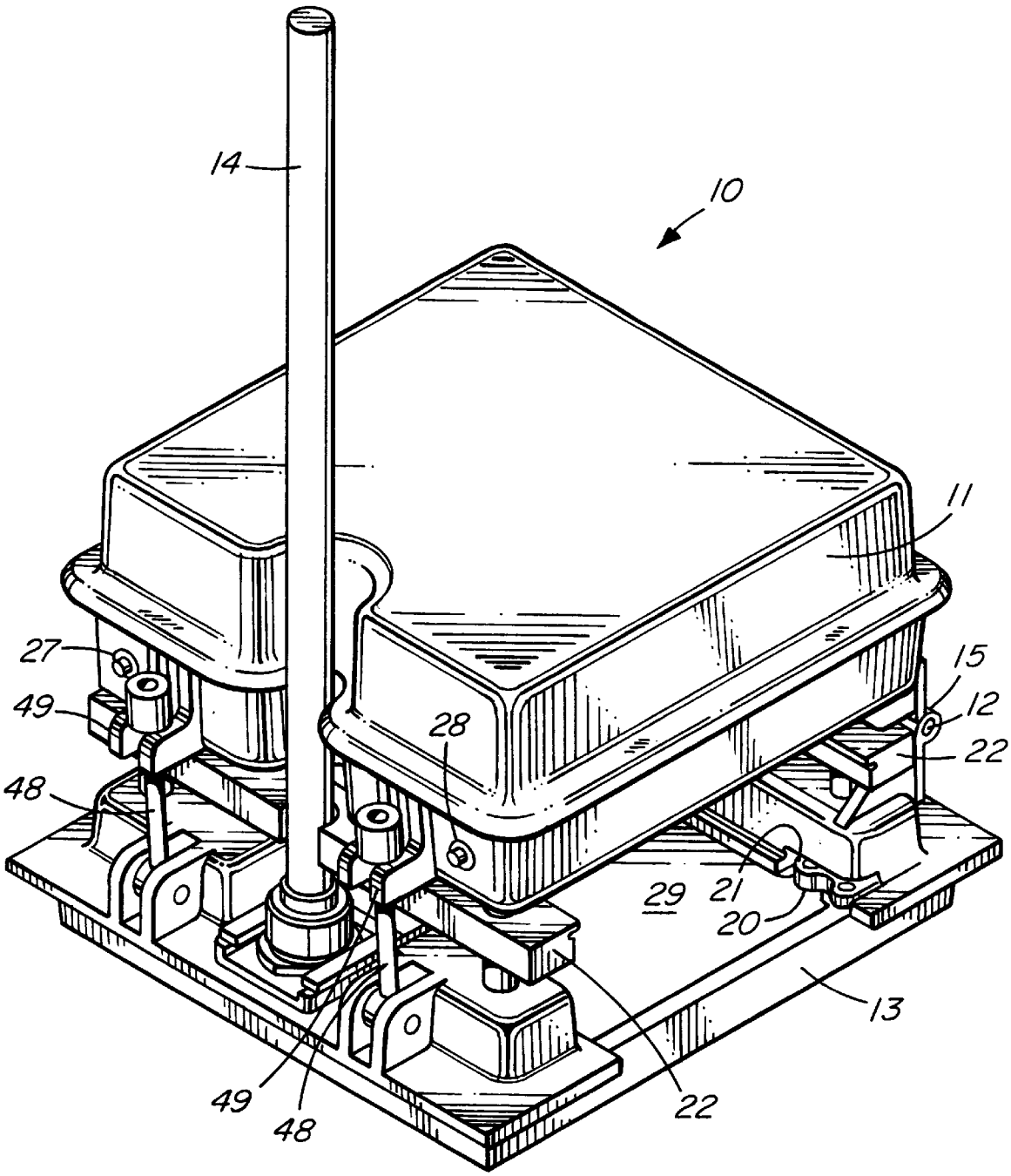
FIG. 1 is a diagrammatic isometric view of the assembly apparatus according to the invention.

Reference is now made to the drawings and, in particular, to FIG. 1, where a container assembly apparatus according to the invention is generally illustrated at 10. It comprises an upper housing 11 rotatable about a hinge 15 at axis 12 and a base 13 which is operable to rest within a recess on an assembly line wherein containers are assembled, a typical one of such containers being illustrated generally at 25 in FIG. 6.

The operation of the machine is conveniently pneumatic and electrical; that is, pneumatic cylinders are utilized in association with solenoids and the like to sequentially perform the assembly operations on the container 25 as will be described in greater detail hereafter.

Figure 7:
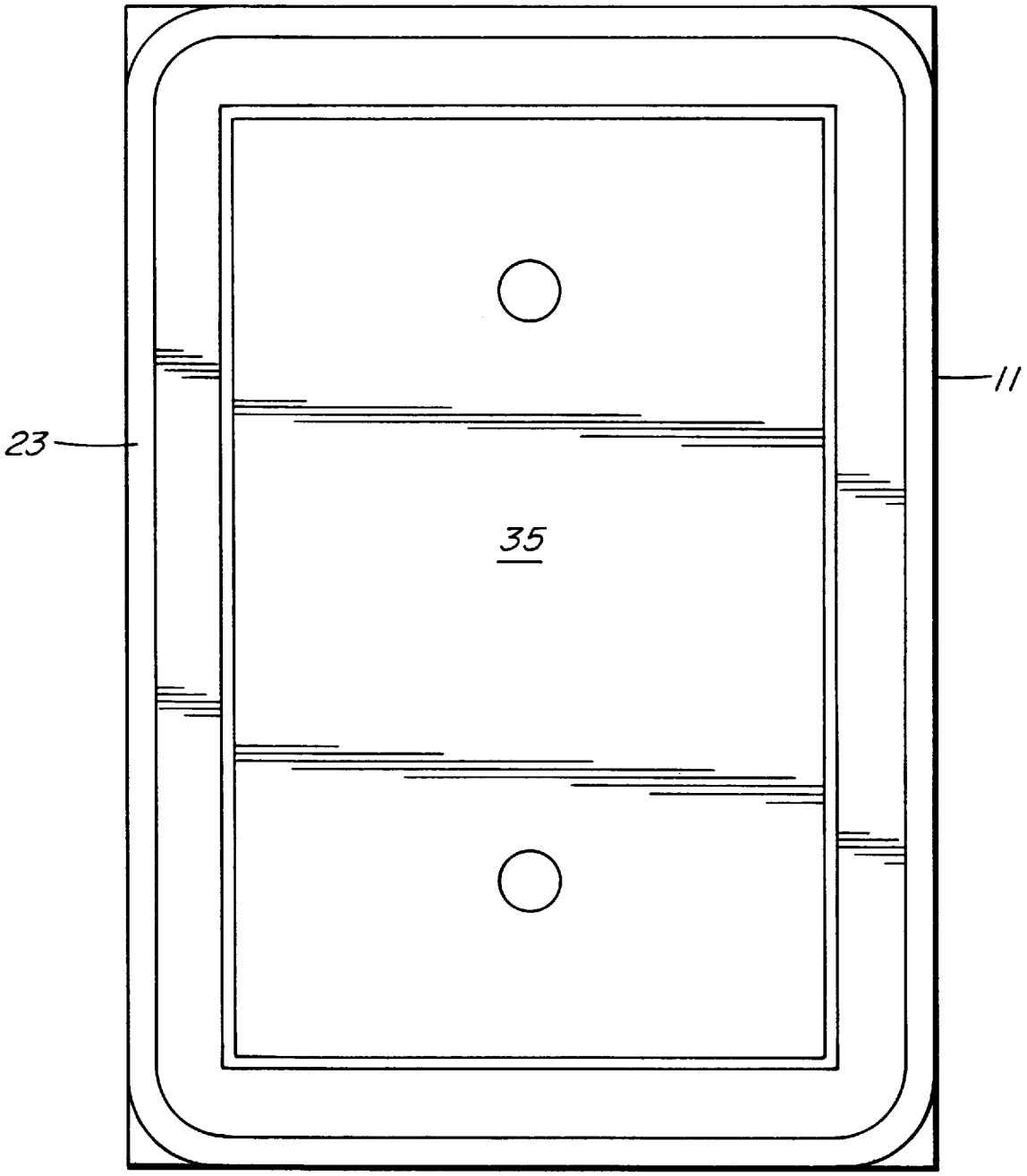
FIG. 7 is a partial and bottom view of the platen used to press the lid into its closing position on the container body.

The upper housing 11 holds the bulk of the electrical control components and the pneumatic components for operation of the platen 23 (FIG. 7). The platen 23 moves vertically relative to the upper housing 11 by a pneumatic cylinder (not illustrated).

Figure 6:
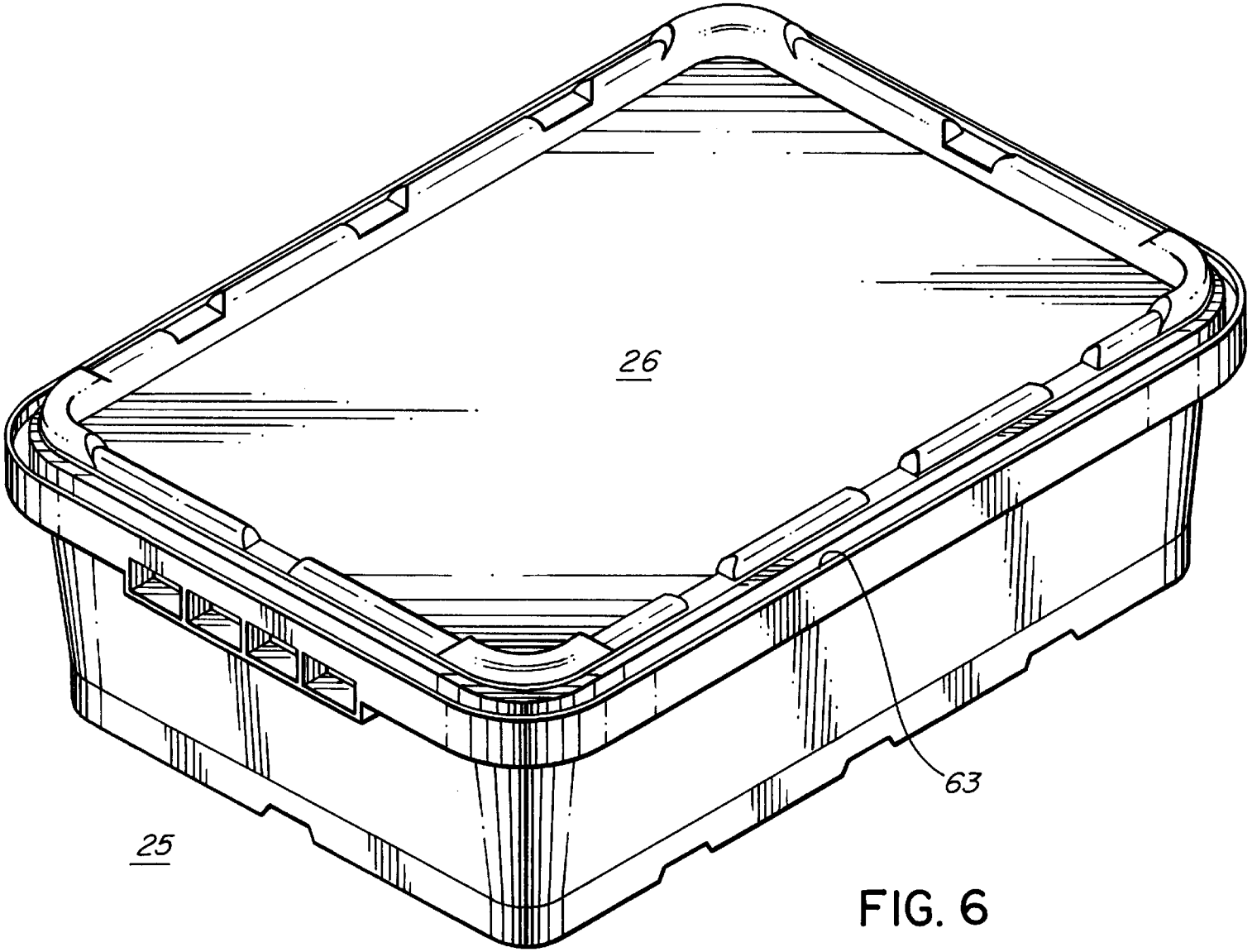
FIG. 6 is an isometric view of a typical container including the lid of the container which is assembled according to the invention.

A plug holder or plug magazine 14 extends vertically from the base 13. It holds a plurality of plugs 30 (FIG. 3), one of which is installed in the hole 31 of the container 25 (FIG. 6). A rotatable arm 32 (FIG. 2) moves a single plug 30 from the magazine tube 14 by vacuum action as will be described hereafter.

Two swing arms 20 (FIG. 2), one located in each end of the container assembly apparatus 10, operate to position and hold the container 25 in its assembly position within the container assembly apparatus 10. Each of the swing arms 20 rotates in a horizontal plane about a respective axis 21 and is controlled by a respective pneumatic cylinder 65. Generally horizontal plastic rails 22, one on each side of the container assembly apparatus 10 guide the lid 26 of the container 25 (FIG. 6) into its assembly position and maintain it in position prior to installation on the container 25 as will be described. The plastic rails 22 are vertically adjustable as may be desired for more closely controlled distances between the lid 26 and the body of the container 25.

Figure 2:
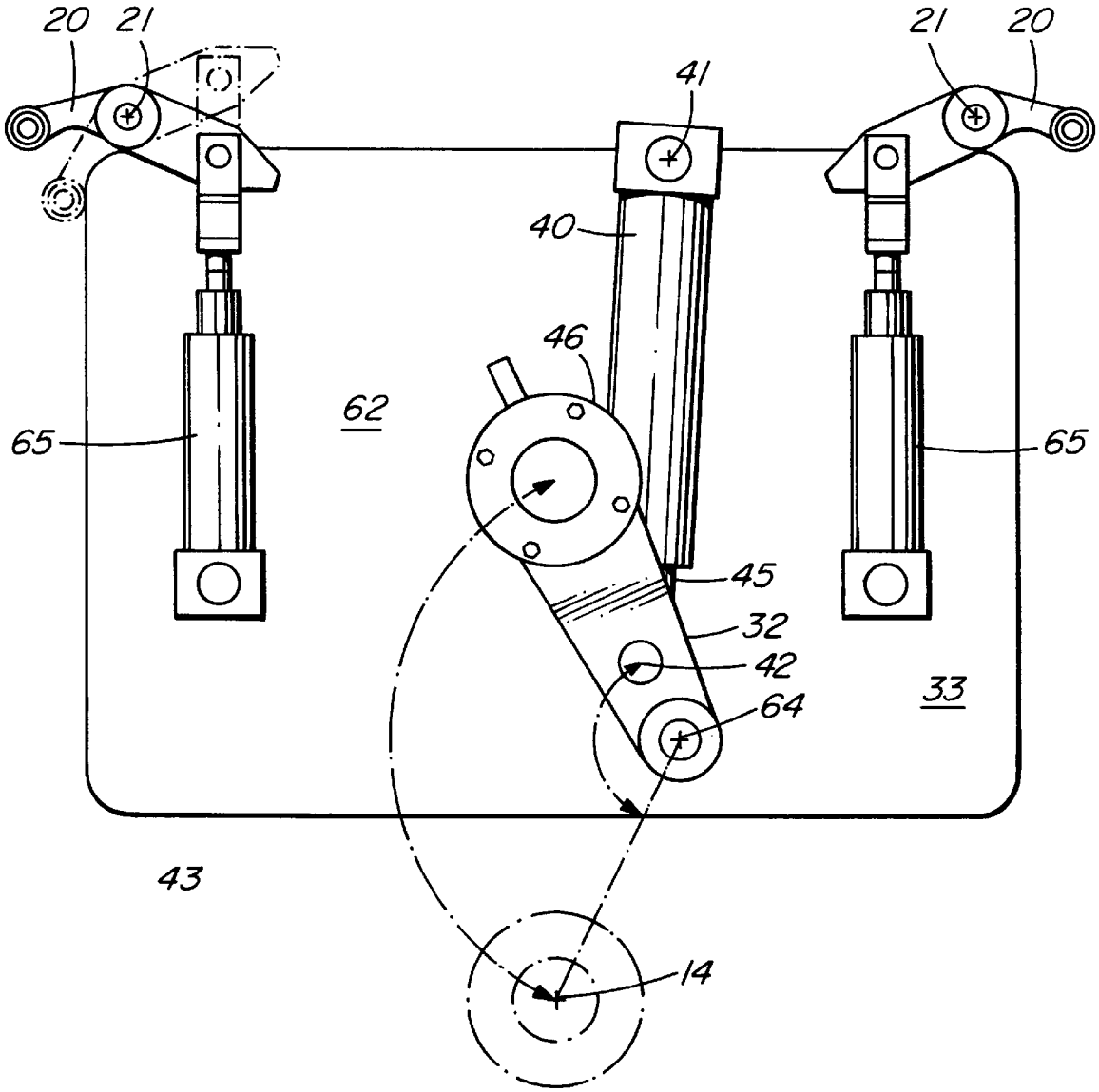
FIG. 2 is a partial and diagrammatic plan view of the assembly apparatus particularly illustrating the plug removal, transport and insertion mechanism.
Figure 3:
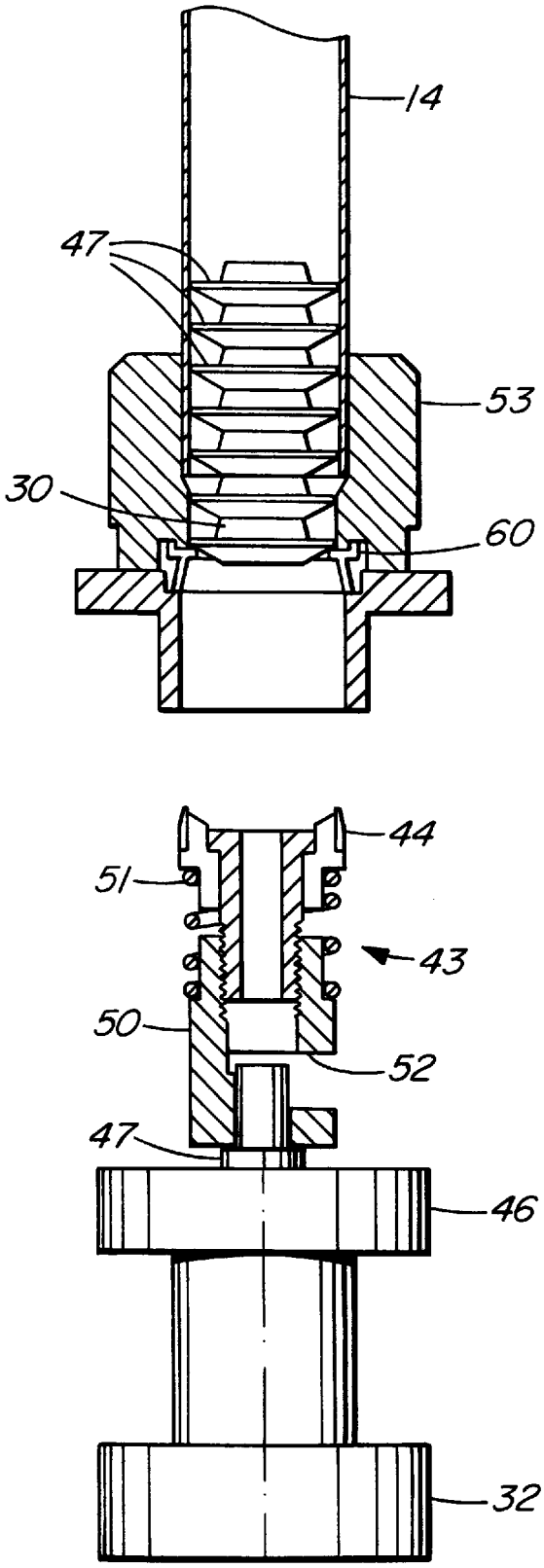
FIG. 3 is a partial side view of the magazine tube with a plurality of plugs positioned therein and the plug removal mechanism moving up to obtain and receive a plug from the magazine tube;.

The plug removal, transfer and inserter mechanism is generally illustrated at 33 in FIG. 2. It includes a pneumatic transfer cylinder 40 which is pivotable about axis 41 and which has an arm 45 connected to plug transfer arm 32 at axis 42 in order to rotate the arm 45 from its loading position to its insertion position as is illustrated. It further comprises plug transfer cylinder 46 together with its associated plug loader mechanism generally illustrated at 43 (FIG. 3).

The plug transfer mechanism 43 includes an alignment bushing 44, a plug loader body 50 and a spring 51 which biases a separation between the alignment bushing 44 and the plug loader body 50. Alignment bushing 44 moves relative to plug holder body 50; that is, the alignment bushing 44 moves vertically relative to the plug holder body 50 during the plug removal and insertion operations.

A vacuum port 52 is formed in the plug loader body 50 and extends to the alignment bushing 44. This attracts the bottommost plug 30 from the plug magazine 14 as will be described.

The magazine tube 14 is mounted within a magazine tube holder 53 and carries a plurality of plugs 47. The bottommost plug 30 sits on a separator ring 60 which holds the bottommost plug 30 in its seated position.

OPERATION

In operation, a plurality of containers are positioned consecutively, one following the other, in a line extending and moving into the container assembly apparatus 10 in a direction indicated by the arrow in FIG. 1. That is, the containers 25 extend end to end, and it will be assumed that the assembly line is moving from left to right as viewed in FIG. 1 as indicated. The lid 26 (FIG. 6) is manually positioned on the body of the container 25 into contact with an edge 63 of the container 25. The container 25 is moving rightwardly with reference to FIG. 1 and the operator will consecutively and simultaneously operate the buttons 27, 28 as will be described.

The operator will initially press button 27. This will open swing arm 20 located on the left end (FIG. 2) by retracting the piston of pneumatic cylinder 65 of the apparatus 10 and will allow the container to pass under the upper housing 11. At the same time, swing arm 20 on the rightward end of the apparatus 10 will close by extending the piston extending from pneumatic cylinder 65; that is, swing arm 20 will rotate about axis 21 under the influence of pneumatic cylinder 65 from the position shown to a position where the swing arm 20 prevents movement of the container further through the machine and holds it in the assembly position. As the container 25 moves into the apparatus 10, the rails 22 located on each side of the container opening 29 (FIG. 1) will bring the lid 26 into closer contact with the container 25 all along the upper surface of the body of the container 25. While holding button 27 inwardly, the operator will then press button 28. The two buttons 27, 28 are provided for safety purposes to prevent the hands of the operator being within the apparatus 10 during the assembly operation. The operation of both buttons 27, 28 will commence operation of the plug removal, transfer and insertion operations and will close the left swing arm 20 thereby to hold the container 25 in position within apparatus 10.

Figure 4:
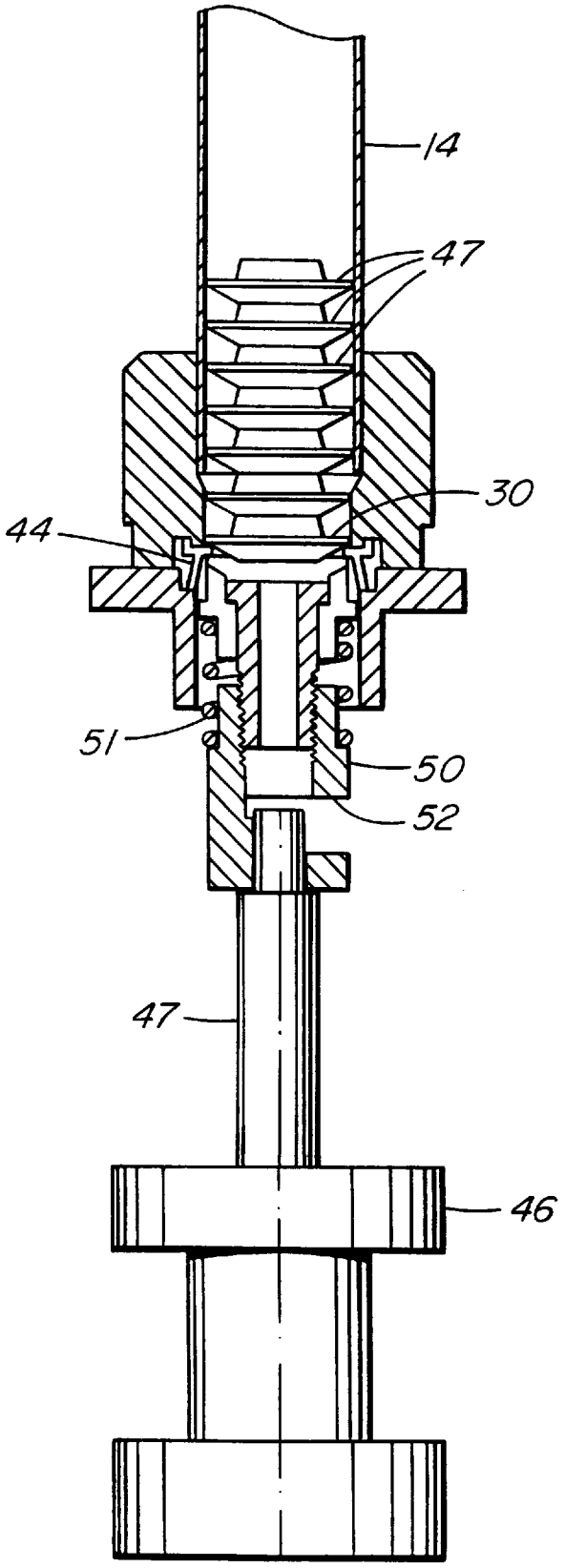
FIG. 4 is a view similar to FIG. 3 but illustrating the plug removal mechanism in position to obtain a plug from the plug magazine.

When the operator initiates operation of the removal, transfer and insertion mechanism 33 (FIG. 2) by pressing button 28, the container 25 will be in its assembly position within the container assembly apparatus 10. The arm 32 will pivot about axis 64 counterclockwise as viewed in FIG. 2 until it reaches its position directly beneath the plug magazine 14 (FIG. 3). A vacuum will be applied to the plug loader body 50 through the vacuum port 52 and a piston 47 will be extended to raise the plug holder body 50. The bottommost plug 30 is then sucked into the plug holder body 50 (FIG. 4).

Figure 5:
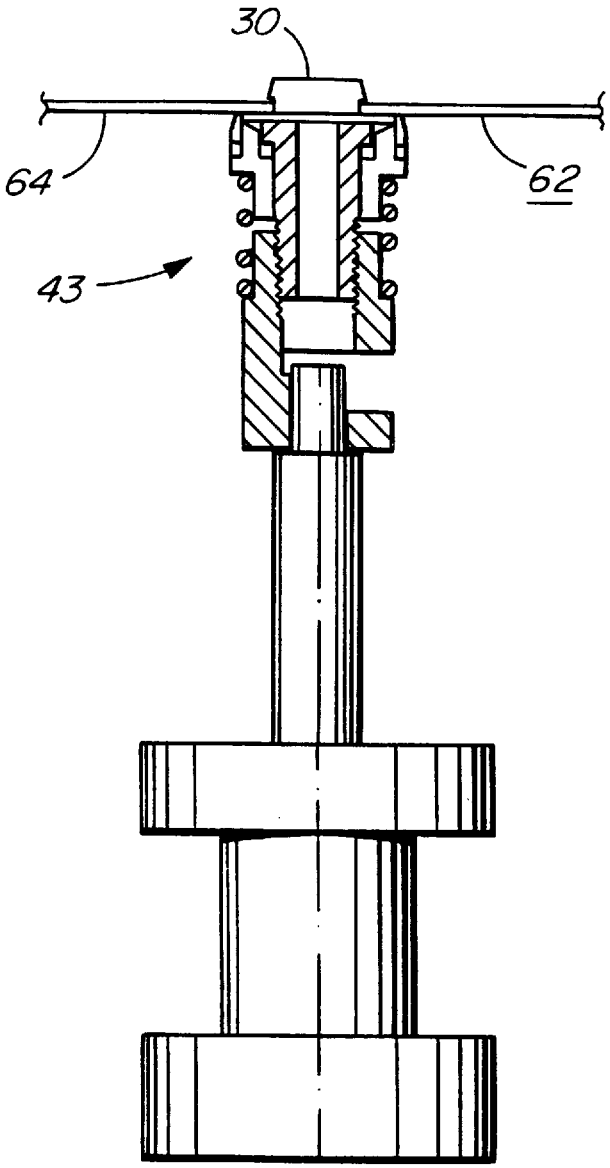
FIG. 5 is a partial and diagrammatic side view of the plug insertion mechanism which is illustrated inserting a plug into the floor or bottom of the container.

Thereafter the transfer arm 32 is rotated within the base 13 of the apparatus 10 about axis 64 from the load position illustrated by broken lines in FIG. 2 to a position directly beneath the container 25, that position shown in solid lines in FIG. 2. The assembly process will commence. The lid 26 of the container 25 is moved downwardly by the platen 23 (FIG. 7) until the lid 26 is assembled to the body of the container 25. Simultaneously, the plug insertion mechanism 43 will move upwardly and insert the plug 30 into the floor 64 of the container 62 (FIG. 5). The container 25 and lid 26 will then be assembled and the operator will release the buttons 27, 28. This will open swing arm 20. The assembled container 25 is manually moved to a shipping area from the assembly area within apparatus 10 where the various operations prior to shipping can then occur. Since the containers 25 are in a contacting end-to-end relationship, when the assembled container 25 leaves the assembly apparatus 10 in the direction indicated in FIG. 1, the swing arm 20 will sense the recess between the two consecutive containers 25 and close thereby stopping the sequentially following container and maintaining it in its assembled position.

For cleaning purposes, the upper housing 11 is rotated clockwise about axis 12 of hinge 15 by removing two toggles 48 from their respective brackets 49. The interior is then fully exposed and the cleaning operation can conveniently take place. Likewise, the plug magazine 14 is a one piece design and is removable from the apparatus 10 in its entirety.

The operation of the apparatus 10 is reversible; that is, if the containers 25 move from right to left, opposite to the arrow indicated in FIG. 1, then the operation of the buttons 27, 28 is also reversed. Button 28 will be activated to close the swing arm 20 on the leftward side of the apparatus 10 and button 27 will be activated to initiate the lid installation and plug insertion operation.

It will be noted that since the roe within container 25 typically cause the lid 26 to bulge in the center when it is assembled to the body of the container 25, the platen 23 presses the lid 26 to the container 25 by the edges only (FIG. 7). The recess 35 in the central area of the platen 23 allows for the bulge and prevents undue damage to the roe during assembly of the container 25.

It will likewise be noted that although rails 22 are illustrated in FIG. 1 as being preferable and operable to guide the lid 26 into a closer relationship with container 26 during the movement of the container 25 into the assembly apparatus 10, rolls (not shown) would also function appropriately on both sides of the container opening 29. They would act similarly to the rails 22 to give integrity to the lid movement during the movement of the container 25 into the apparatus 10 and allow for a better relationship between the lid 26 and the container 25 prior to assembly.

Many modifications will readily occur to those skilled in the art to which the invention relates and the specific embodiments described should be considered as illustrative of the invention only and not as limiting its scope as defined in accordance with the accompanying claims.

I claim:

1. A method of assembling a container lid to a body of a container and inserting a plug into an opening on the floor or lower panel of said container, said method comprising the steps of manually bringing the lid of the container into contact with the body of said container at at least one side of said lid and said container, positioning said container in an operating location and maintaining said container in said operating location during assembly of said lid to said container, applying pressure to said lid of said body of said container while simultaneously moving said plug from a plurality of plugs with a plug removal and plug insertion mechanism operably timed with said pressure application, and inserting said plug into said opening.

2. Method of claim 1 wherein said lid of said container has edges and said container is positioned within said operating location by moving said container to said operating location and simultaneously applying downwards force on said edges of said lid thereby to bring said lid into a generally uniform distance from said body of said container prior to assembly of said lid to said body of said container.

3. Method of claim 2 and further comprising closing a swing arm at the exit area of said operating location thereby to terminate movement of said container by contact between said swing arm and said container.

4. Method of claim 3 wherein said swing arm is closed by operating a control button.

5. Method of claim 3 and further comprising operating a second button to initiate downwards movement of a platen, said first and second buttons being operated simultaneously.

6. Method of claim 5 and further comprising initiating movement of said plug insertion mechanism simultaneously with said downwards movement of said platen, said plug being inserted into said opening while said lid is assembled to said container.

7. Method of claim 6 and further comprising removing said plug from a plug magazine prior to downwards movement of said platen and moving said removed plug to a position directly below said opening.

8. Method of claim 7 wherein said lid is assembled to said container and said plug in inserted into said opening generally simultaneously.

9. Apparatus for the assembly of a lid to a container and of a plug in an opening in the bottom of said container, said apparatus comprising a storing mechanism for the storage of a plurality of plugs, a platen movable on a press and being operable to contact and press said lid into a closing relationship with said body of said container, a plug removal and plug insertion mechanism for removing one plug from said plurality of plugs, said plug removal and plug insertion mechanism being operably connected in a timed relationship with said movable platen, transferring said one plug to said opening in said bottom of said container and inserting said one plug into said opening of said container while simultaneously applying pressure to said lid by said platen during insertion of said plug into said opening.

10. Apparatus according to claim 9 and further comprising a lid guide to bring said lid of said container into closer relationship with the top edges of said container.

11. Apparatus as in claim 10 wherein said lid guide extends along both sides of said entrance and exit openings of said apparatus.

12. Apparatus as in claim 11 and further comprising a first swing arm operable to open and thereby admit said container to said operating position and a second swing arm operable to close and thereby terminate movement of said container in said operating position.

13. Apparatus as in claim 12 and further comprising a first button operable to open said first swing arm.

14. Apparatus as in claim 13 and further comprising a second button operable to commence downwards movement of said platen.

15. Apparatus as in claim 14 wherein said first and second buttons are operated simultaneously during downward movement of said platen.

16. Apparatus as in claim 15 and further comprising a plug removal mechanism to remove a plug from said plug magazine.

17. Apparatus as in claim 16 wherein said plug removal apparatus includes a vacuum port to create a vacuum between said plug removal mechanism and said plug thereby to remove said plug from said plug magazine and to hold said plug on said plug removal mechanism.

18. Apparatus as in claim 17 and further comprising a plug transfer mechanism for moving said plug from said plug magazine to a position adjacent said opening of said floor of said container.

19. Apparatus as in claim 18 wherein said plug transfer mechanism comprises an arm rotatable between a first position wherein said plug removal mechanism is located adjacent said plug magazine and a second position wherein said plug removal mechanism is adjacent said opening of said container.

20. Apparatus as in claim 19 wherein said arm is rotatable by a cylinder and piston connected to said plug transfer mechanism.

21. Apparatus as in claim 20 and further comprising a plug insertion mechanism to insert said plug into said opening, said plug insertion comprising an upper plug loader body and an alignment bushing movable relative to said plug loader body.

22. Apparatus as in claim 21 wherein said plug loader body is vertically movable by a cylinder and piston.

23. Apparatus as in claim 22 wherein said alignment bushing is biased apart from said plug loader body.

24. Apparatus as in claim 23 wherein said vacuum port is located in said plug loader body.

25. Apparatus as in claim 24 wherein said assembly apparatus comprises an upper body portion and a base, said upper body portion being rotatable relative to said base from an operating to a cleaning position.

26. Apparatus as in claim 25 wherein said upper body portion is held in operating position by toggles extending between said base and said upper body portion, said toggles being removable thereby to release said upper body portion from said operating position and allowing said upper body portion to rotate relative to said base.

* * * * *